US006543952B1

(12) United States Patent
Ohba

(10) Patent No.: US 6,543,952 B1
(45) Date of Patent: Apr. 8, 2003

(54) COSMETIC MATERIAL VESSEL AND COSMETIC MATERIAL VESSEL CARTRIDGE

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/830,670

(22) PCT Filed: Nov. 2, 1999

(86) PCT No.: PCT/JP99/06105

§ 371 (c)(1),
(2), (4) Date: Apr. 30, 2001

(87) PCT Pub. No.: WO00/25626

PCT Pub. Date: May 11, 2000

(30) Foreign Application Priority Data

Nov. 2, 1998 (JP) ..... 10-311906

(51) Int. Cl.[7] ..... A45D 40/04

(52) U.S. Cl. ..... 401/68; 401/87; 401/98; 401/174

(58) Field of Search ..... 401/68, 70, 75, 401/78, 87, 98, 174, 175

(56) References Cited

U.S. PATENT DOCUMENTS

| | | | | |
|---|---|---|---|---|
| 2,815,123 A | * | 12/1957 | Safianoff | 401/68 |
| 5,018,893 A | | 5/1991 | Holloway | |
| 5,076,720 A | * | 12/1991 | Roger | 401/68 |
| 5,816,727 A | * | 10/1998 | Ohba et al. | 401/68 |

FOREIGN PATENT DOCUMENTS

| | | |
|---|---|---|
| JP | 60-33919 | 3/1985 |
| JP | 60-48706 | 3/1985 |
| JP | 4-30961 | 7/1992 |
| JP | 3030037 | 7/1996 |
| JP | 8-228836 | 9/1996 |
| JP | 3043356 | 9/1997 |
| JP | 9-224741 | 9/1997 |
| JP | 9-308525 | 12/1997 |
| JP | 10-243816 | 9/1998 |

* cited by examiner

*Primary Examiner*—Gregory Huson
*Assistant Examiner*—Peter deVore
(74) *Attorney, Agent, or Firm*—Rabin & Berdo, P.C.

(57) ABSTRACT

There are provided a cosmetic container for housing a stick type cosmetic material in such a manner that the cosmetic material can be fed and a cartridge for the cosmetic container which can easily be manufactured or assembled at a low cost, have considerable flexibility in design and are applicable to stick type cosmetic materials having various diameters and hardness. A cylindrical body 20 is housed in a lower part 13 of a front cylinder 10 which is rotatably housed in a container body 2 and a rod 30 is incorporated extending over an inside of the cylindrical body 20 and a cosmetic material housing section 11A of an upper part 11 of the front cylinder 10, whereby a cartridge 1 is constituted. A stick type cosmetic material 4 is retained at a cosmetic material retaining section 31 on a front end side of the rod 30, a plurality of engagement projections 35 are formed at an outer circumference of the rod 30, and these engagement projections 35 are spirally engaged one after another with a spiral groove 23 formed at a spiral cylinder section 22 on an upper end side of the cylindrical body 20. Connection of the cartridge 1 with the container body 2 is made by engagement of a spline section 25 provided at an inner circumference of a base end of the cylindrical body 20 and a spline shaft 43 fixed to the container body 2.

6 Claims, 10 Drawing Sheets

COSMETIC MATERIAL VESSEL AND COSMETIC MATERIAL VESSEL CARTRIDGE

TECHNICAL FIELD

The present invention relates to an improvement in a cosmetic container for housing a stick type cosmetic material in such a manner that the material can be fed and a cartridge for the container.

BACKGROUND ART

With regard to a cosmetic container which feeds a stick type cosmetic material contained in a cartridge, such as eyeliner, eyebrow pencil, eye shadow, or lipstick, due to relative rotations of the cartridge and a container body, fore example, there are proposals in Japanese Patent Laid-Open publication No. Sho 60-48706 and Japanese Utility Model Publication No. Hei. 4-30961, and the like which are official gazettes published by the Japanese Patent Office.

Among them, a cosmetic container disclosed in Japanese Patent Laid-Open Publication No. Sho 60-48706 is shown in FIGS. 11 and 12.

An inner cylinder 103 which coaxially extends is installed in a front cylinder 102 of a cartridge 101 as one body. A thread cylinder 104 arranged between the inner cylinder 103 and the front cylinder 102 in such a manner that relative rotations can freely be made is connected by spline with a holder section 106 of a container body 105 in such a manner that relative rotations cannot be made. Further, engagement projections 109 formed at a retaining member 108 for retaining a stick type cosmetic material 107 are engaged with both sliding grooves 110 which are formed at the inner cylinder 103 extending in an axial direction and spiral groove 111 which are spirally formed around a shaft of the thread cylinder 104.

Thus, when the cartridge 101 and the container body 105 are relatively rotated, the inner cylinder 103 and the thread cylinder 104 are relatively rotated and the engagement projections 109 engaged with a spiral groove 111 advance according to the rotations, but the engagement projections 109 cannot rotate because these are also engaged with the sliding grooves 110 which extend in an axial direction. Therefore, the engagement projections 109 move only in an axial direction.

Thus, the retaining member 108 united with the engagement projections 109 moves in a direction of a front end of the front cylinder 102, and the stick type cosmetic material 107 retained by the retaining member 108 is fed through an opening 112 provide at a front end of the front cylinder 102.

However, in the cosmetic container disclosed in Japanese Laid-Open Publication No. Sho 60-48706, it is necessary to engage the engagement projections of the retaining member 108 with both the sliding grooves 110 and the spiral groove 111. Therefore, it is necessary to coaxially pile up the inner cylinder 103 at which the sliding grooves 110 are formed and the thread cylinder 104 at which the spiral groove 111 is formed, whereby a diameter of the cosmetic container becomes large.

A cosmetic container disclosed in Japanese Patent Publication No.

Hei 4-30961 is shown in FIG. 13.

Sliding grooves 203 are formed on an inner circumferential surface on a front end side of a front cylinder 202 of a cartridge 201, whereas a spiral cylinder 205 at which a spiral groove 204 is formed is rotatably housed on a rear end side of the front cylinder 202. With regard to a retaining member 207 which retains a stick type cosmetic material, engagement projections 208 on its front end side are engaged with the sliding grooves 203 and also engagement projections 209 on its base end side are engaged with the spiral groove 204.

The cartridge 201 is housed in a container body which is not shown in the drawings in such a manner that relative rotations can freely be made, and the spiral cylinder 205 is connected with the container body in such a manner that relative rotations cannot be made.

Due to such constitution, a part of the front cylinder 202 at which the sliding grooves 203 are formed and the spiral cylinder 205 can be arranged in an axial direction and in series and they are not coaxially piled up, thereby enabling the cosmetic container to be thin as a whole.

In the cartridge 201 disclosed in Japanese Patent Publication No. Hei 4-30961, the engagement projections 209 formed at the base end of the retaining member 207 are spirally engaged with the spiral groove 204 provided at the inner circumference of the spiral cylinder 205, and when the spiral cylinder 205 is rotated, the engagement projections 209 move in an axial direction by a distance equivalent to a stroke of the retaining member 207 and the stick type cosmetic material 206.

Thus, the spiral groove 204 has to be at least longer in an axial direction than a stroke length of the stick type cosmetic material 206. However, from a technical point of view, it is difficult to make such a long spiral groove 204 in molding the spiral cylinder 205.

To be more precise, usually, molding of the spiral cylinder 204 is performed at an outer circumference of a core pin provided at a forming die, and the spiral groove 204 is formed in accordance with the shape of an outer circumferential surface of the core pin. And, the spiral cylinder 205 after molding is removed from the core pin. In this case, if the spiral cylinder 205 is short, it can easily be drawn out from the core pin, but if the spiral cylinder 205 is long, it cannot be detached from the forming die unless the core pin is rotated.

Particularly, in order to simultaneously produce a plurality of spiral cylinders 205 using a single forming die, it is necessary to provide the forming die with a plurality of rotatable core pins. In this case, the forming die becomes complicated and the maintenance is difficult. If the forming die is simplified to have only a single core pin, productive efficiency cannot be increased.

Further, if the stick type cosmetic material 206 is long and narrow, a stroke of the retaining member 207 will be longer, whereby the spiral cylinder 205 will be long and narrow. Thus, it is difficult to form the spiral groove 204 covering the total length of such long and narrow spiral cylinder 205. This also becomes a cause of the increase of costs of a cosmetic container.

Further, in the case of a cosmetic container, it is preferable for various cartridges for stick type cosmetic materials of various diameters, such as extrafine diameter (for example, approximately 1.5 mm to 2.0 mm) and relatively large diameter (for example, approximately 6 mm to 8 mm in the case of a lipstick or the like) to be applicable to a common container body according to the use. Therefore, it is necessary for cartridges to have structure applicable to stick type cosmetic materials of various diameters.

However, in the cartridge 201 described above, it is not taken into consideration that if a stick type cosmetic material

206 having an extrafine diameter and insufficient hardness is installed, for example, it may be damaged or detached from the retaining member 207 when the retaining member 207 is twisted at the feeding limit of the stick type cosmetic material 206.

The present invention is made in consideration of the problems described above. An object of the present invention is to provide a cosmetic container which houses a stick type cosmetic material in such a manner that the material can be fed and a cartridge for the container. These are easy to manufacture and assemble at a low cost, have considerable flexibility in design, and are applicable to stick type cosmetic materials having various diameters and hardness.

DISCLOSURE OF THE INVENTION

A cartridge according to the present invention has a front cylinder which feeds a stick type cosmetic material through a front end opening. Further, the cartridge is composed of a cylindrical body coaxially and rotatably connected to the front cylinder, a rod which is inserted in the cylindrical body, a plurality of engagement projections formed at an outer circumference of the rod, a spiral groove which is formed at a part of an inner circumference of the cylindrical body and which the plurality of engagement projections are spirally engaged with, a cosmetic material retaining member which is formed on a front end side of the rod and also arranged in the front cylinder, and a sliding mechanism which makes the cosmetic material retaining section unrotatble around a shaft of the front cylinder and slidable in an axial direction of the front cylinder, wherein the cosmetic material retaining section is slid as one body with the rod due to relative rotations of the front cylinder and the cylindrical body.

Further, according to the present invention, the plurality of engagement projections are formed in an axial direction of the rod at least ranging over a stroke length of the rod, and also the spiral groove is engaged only with a part of the plurality of engagement projections at each stroke position of the rod.

Thus, when the stick type cosmetic material is fed from the cosmetic container, with the cartridge housed in a container body, a front cylinder of the cartridge is rotated in a predetermined direction with respect to the container body. In this case, the rod connected to the front cylinder via the sliding mechanism in such a manner that the rod cannot rotate in an axial direction is rotated together with the front cylinder as one body. On the other hand, since the cylindrical body does not rotate with respect to the container body, eventually the rod rotates with respect to the cylindrical body. Thus, the rod which is spirally engaged with a spiral cylinder section of the cylindrical body due to the plurality of engagement projections is fed out in an axial direction through an opening provided at a front end of the cylindrical body, and the stick type cosmetic material retained by the cosmetic material retaining section of the rod is fed out through an opening provided at a front end of the cylindrical body. On the other hand, in order to retract the stick type cosmetic material into the cosmetic container, it will be sufficient if the front cylinder of the cartridge is rotated in a reverse direction with respect to the container body.

As described above, a feeding mechanism of stick type cosmetic materials (a mechanism for feeding a rod from a cylindrical body) is composed of engagement projections and a spiral groove. The pluralities of engagement projections are provided at an outer circumference of the rod. Thus, for example, if it is arranged such that the plurality of engagement projections are installed in an axial direction of the rod at least ranging over a stroke length of the rod and a part of these engagement projections is engaged with a spiral groove of a spiral cylinder section one after another according to a stroke position, a stroke of the stick type cosmetic material can be secured even though the spiral groove is drastically shorter than the stroke length. Therefore, when the rod is molded out of plastic by injection, since the spiral groove is short, the extraction from a die member (for example, a core pin) can easily be performed and a special mechanism for rotating the die member or the like is not required. Thus, it can easily be manufactured and the production costs can be reduced.

Further, according to the present invention, a stopper member is installed on a base end side of the rod, whereas a downward step section is formed at the cylindrical body and a stroke position where the s topper member and the downward step section come into contact in a stroke of the rod is defined as a stroke limit.

Further, according to the present invention, the spiral cylinder section at which the spiral groove is formed is provided on a front end side of the cylindrical body, and also a lower end of the spiral cylinder is rendered to be the downward step section.

Due to the constitution described above, a stroke limit of the rod is defined by the contact of the stopper member and the downward step section, thereby stabilizing the stroke of the stick type cosmetic material.

Further, according to the present invention, the entire cylindrical body is housed in the front cylinder.

Further, according to the present invention, the front end side of the cylindrical body is rotatably connected to an inside diameter of the front cylinder and also the base end side of the cylindrical body is exposed from the front cylinder.

Further, according to the present invention, the sliding mechanism is composed of an engagement section which is formed at an outer circumference of the cosmetic material retaining section and a sliding section which is formed at an inner circumference of the front cylinder and is engaged with the engagement section.

As described above, since the sliding mechanism is composed of the engagement section and the sliding section, it is possible to constitute a simple sliding mechanism which provides secure guidance in an axial direction.

Further, according to the present invention, the plurality of engagement projections are arranged on a straight line which extends in an axial direction, and also the engagement projections are engaged with the sliding section when fed from the front end side of the cylindrical body.

Since the engagement projections are engaged with the sliding section of the sliding mechanism as described above, an inside diameter of a part of the front cylinder at which the sliding section is formed can be almost as small as an outside diameter of the rod, whereby the cartridge can be slender. Further, the engagement projections also serve as an engagement section of the sliding mechanism, and therefore sliding operation of a push rod becomes stable and also the cartridge becomes stronger to resist a load in a torsional direction due to support by the engagement projections.

Further, according to the present invention, the cosmetic material retaining section is composed of a plurality of claws, and these claws are used as the engagement section. Also, a plurality of engagement grooves with which the claws are engaged are formed at an inner circumference of the front cylinder and used as the sliding section.

Further, according to the present invention, the plurality of engagement projections are arranged coaxially with the claws, and the engagement projections are engaged with the engagement grooves when fed from the front end side of the cylindrical body.

Further, according to the present invention, it is constituted such that the plurality of claws are installed in a standing position around a base section of the cosmetic material retaining section which is fixed to the rod and the cosmetic material is retained inside the plurality of claws. Also, a width of projection, in a direction of a diameter of the cartridge, of a part of the claws which retains the cosmetic material is equal to or narrower than a width of projection of the claws at the base section which is fixed to the rod and a width of projection of the plurality of engagement projections in a direction of a diameter of the cartridge.

According to the present invention described above, the claws which retain the stick type cosmetic material also serve as the engagement section and therefore the cartridge can have simple and rational constitution.

Further, since a width, in a direction of a diameter of the cartridge, of a part of the claws which retains the cosmetic material is equal to or narrower than a width of projection of a part of the claws which is fixed to a body of the rod and a width of projection, in a direction of a diameter of the cartridge, of the plurality of engagement projections, a heavy load is not applied to the part of the claws which retains the cosmetic material even during the operation of the cosmetic container. Consequently, it is possible to prevent the cosmetic material from being damaged or from coming off from the claws.

Further, the present invention is composed of any one of the cartridges described above and a container body in which the cartridge is housed in such a manner that the cartridge can easily be attached and detached, wherein when the cartridge is housed in the container body, the front cylinder is connected rotatably with respect to the container body, whereas the cylindrical body is connected unrotatably with respect to the container body.

BEST MODE FOR CARRYING OUT THE INVENTION

Embodiments of the present invention will subsequently be described with reference to the accompanying drawings.

Figure 1:
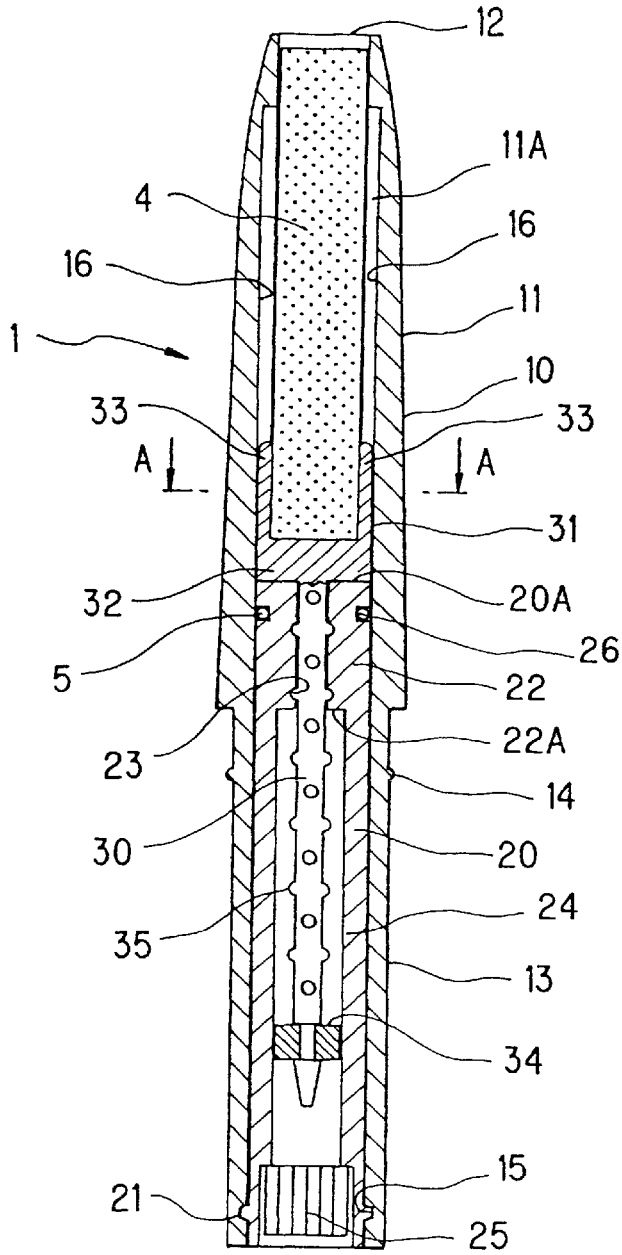
FIG. 1 is a sectional view showing a cartridge according to a first embodiment of the present invention.
Figure 2:
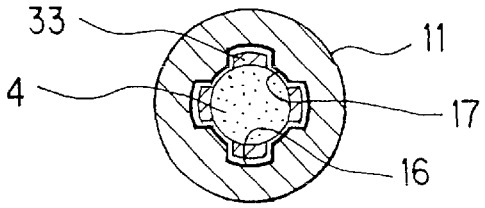
FIG. 2 is a sectional view taken along line A—A of FIG. 1.
Figure 3:
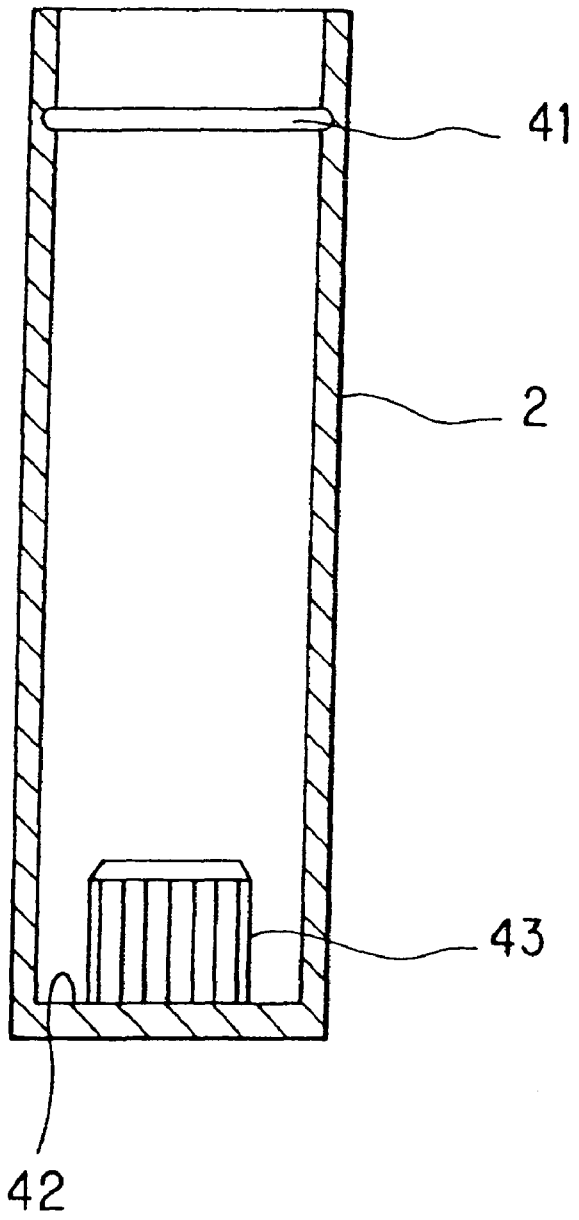
FIG. 3 is a sectional view showing a container body.

Referring to FIGS. 1 and 2, a cartridge 1 for a cosmetic container according to a first embodiment of the present invention is shown. Further, FIG. 3 shows a container body 2 of the cosmetic container in which the cartridge 1 is housed in such a manner that the cartridge 1 can easily be attached and detached.

As shown in the drawings, the cartridge 1 is provided with a front cylinder 10, a cylindrical body 20, and a rod 30.

With regard to the front cylinder 10 which is a cylindrical member, the inside of an upper part 11 on a front end side of the front cylinder 10 is a cosmetic material housing hole 11A in which a stick type cosmetic material 4 is housed. The stick type cosmetic material 4 housed in the cosmetic material housing hole 11A is fed out through an opening 12 provided at a front end of the front cylinder 10 in such a manner that the cosmetic material 4 can easily be fed and retracted.

Further, four engagement grooves 16 extending in an axial direction are formed on an inner circumferential surface of the cosmetic material housing hole 11A in such a manner that the engagement grooves 16 are arranged in a circumferential direction at an approximately 90 degrees to each other. As will be described hereinafter, claws 33 of a cosmetic material retaining section 31 which retains the stick type cosmetic material 4 are engaged with these engagement grooves 16, and the cosmetic material retaining section 31 is guided in an axial direction along the engagement grooves 16.

On the other hand, a lower part 13 on a base end side of the front cylinder 10 has an outside diameter slightly narrower than that of the upper part 11, and the lower part 13 of the front cylinder 10 is housed in a container body 2 through an upper opening of the container body 2 shown in FIG. 3 in such a manner that the front cylinder 10 can easily be attached and detached.

In this case, due to the engagement of a circular engagement convex section 14 provided at an outer circumference of the lower part 13 of the front cylinder 10 and a circular engagement concave section 41 formed on an inner circumferential surface of the container body 2, the front cylinder 10 and the container body 2 are positioned in such a manner that they cannot move (be not extracted) in an axial direction, but can freely rotate relatively to each other.

The cylindrical body 20 is housed in the lower part 13 of the front cylinder 10. The engagement convex section 21 formed at a predetermined position of an outer circumferential surface of the cylindrical body 20 is fitted in an engagement concave section 15 formed on an inner circumferential surface of the front cylinder 10. Thus, the cylindrical body 20 is positioned in such a manner that the cylindrical body 20 cannot move (be not extracted) in an axial direction and can freely rotate in a rotational direction with respect to the front cylinder 10.

In th is case, a base end of the lower part 13 of the front cylinder 10 and a base end of the cylindrical body 20 are aligned, and the cylindrical body 20 is entirely housed in the lower part 13 of the front cylinder 10. The front cylinder 10 and the cylindrical body 20 constitute a cartridge body.

An upper end (front end) of the cylindrical body 20 is a spiral cylinder section 22 which has a predetermined length and a narrow inside diameter. A spiral groove 23 is cut on an inner circumferential surface of the spiral cylinder section 22, and a plurality of engagement projections 35 which will be described later are spirally engaged with the spiral groove 23.

Further, a skirt section 24 which ha s an inside diameter wider than that of the spiral cylinder section 22 is installed on a lower end (base end) side of the cylindrical body 20 which is under the spiral cylinder section 22. On an inner circumferential surface of a base end of the skirt section 24, a spline section 25 which has a plurality of spline grooves extending in an axial direction is formed. Further, a spline shaft 43 which a plurality of spline projections extending in an axial direction are formed at its outer circumference is fixed to a bottom section 42 of the container body 2. When the cartridge 1 is housed in the container body 2, the spline shaft 43 is connected by spline with the spline section 25 provided at a base end of the cylindrical body 20, whereby the cylindrical body 20 and the container body 2 are unrotatably connected.

Further, a ring groove 26 is formed at a predetermined location of an outer circumferential surface of the cylindrical body 20, and an O-ring 5 is fitted in the ring groove 26. Due to resistance which is applied to rotations of the cylindrical body 20 and the front cylinder 10 by the O-ring 5, appropriate frictional resistance is applied to relative rotations of the front cylinder 10 and the container body 2 and rotational operation of the front cylinder 10 and the container body 2 becomes stable.

Incidentally, it will be sufficient if the O-ring 5 is installed between two members (for example, between an outer circumference of the lower part 13 of the front cylinder 10 and an inner circumference of the container body 2) which rotate relatively to each other when the front cylinder 10 and the container body 2 are relatively rotated. Incidentally, if the constitution is such that the O-ring 5 is incorporated in the cartridge 1 like this embodiment, the stick type cosmetic material 4 will previously be prevented from projecting from the front cylinder 10 even though oscillation is applied in a state that the cartridge 1 is removed from the container body 2.

The rod 30 is coaxially housed in the cartridge body (the front cylinder 10 and the cylindrical body 20).

A front end side (the opening 12 side) of the rod 30 is the cosmetic material retaining section 31. The cosmetic material retaining section 31 is provided with a base section 32 and claws 33 composed of four pieces of plates which are installed at the base section 32 in a standing position. The stick type cosmetic material 4 is retained at approximately coaxially with the front cylinder 10 by these claws 33.

These claws 33 are arranged in a circumferential direction at the interval of approximately 90 degrees and are engaged with the engagement grooves 16 described above, respectively. Thus, the cosmetic material retaining section 31 is guided in an axial direction along the engagement grooves 16 and rotations of the cosmetic material retaining section 31 to the front cylinder 10 are prohibited. In other words, the rod 30 does not rotate with respect to the front cylinder 10, but makes a stroke in an axial direction.

As described above, in this embodiment, a sliding mechanism is composed of the engagement grooves 16 and the claws 33, and the engagement grooves 16 serve as a sliding section of the sliding mechanism and the claws 33 serve as an engagement section of the sliding mechanism.

Incidentally, it is preferable that a width of the projection, in a direction of a cartridge diameter, of a part of the claws 33 which retains the stick type cosmetic material 4 is equal to or narrower than a width of the projection, in a direction of a cartridge diameter, of a part of the claws 33 fixed to the base section 32 as shown in the drawing. If so, a heavy load will not apply to the part of the claws 33 which retains the stick type cosmetic material 4. Consequently, it is possible to prevent the stick type cosmetic material 4 being damaged and coming off from the claws 33.

Further, four parts between the engagement grooves 16 serve as sliding surfaces 17. The stick type cosmetic material 4 retained by the cosmetic material retaining section 31 comes into contact with the sliding surfaces 17 from between the claws 33, whereby the stick type cosmetic material 4 is fully supported from the side.

A stopper member 34 is installed at an outer circumference of the rod 30 near its base end. A stroke position where the stopper member 34 comes into contact with a lower end (a downward step section 22A) of the spiral cylinder section 22 when the rod 30 moves in an axial direction becomes an upper stroke limit of the rod 30. On the other hand, a stroke position where a lower end of the base section 32 of the cosmetic material retaining section 31 comes into contact with an upper end (a front end) 20A of the cylindrical body 20 becomes a lower stroke limit of the rod 30.

A lot of engagement projections 35 are arranged at a prescribed pitch in a circumferential direction and in an axial direction at an outer circumference of the rod 30 covering almost all the range from the base section 32 of the cosmetic material retaining section 31 to the stopper member 34 (or at least a sphere covering a stroke length of the rod 30). The group of engagement projections 35 are arranged in such a manner that they are fitted in the spiral groove of the spiral cylinder section 22 described above. The spiral groove 23 and the plurality of engagement projections 35 constitute a feeding mechanism for feeding the stick type cosmetic material 4. More specifically, when the front cylinder 10 (the rod 30) and the cylindrical body 20 rotate relatively to each other, the rod moves in an axial direction in such a manner that the plurality of engagement projections 35 of the rod 30 are spirally engaged with the spiral groove 23 one after another.

The cartridge 1 is constituted as described above and assembled as follows.

First, a base end side of the rod 30 is inserted in an opening on a front end side of the cylindrical body 20 in such a manner that the rod 30 is spirally engaged with the opening, and the rod 30 and the stopper member 34 are incorporated in the cylindrical body 20. The cylindrical body in which the rod 30 is incorporated is then inserted through an opening on a base end side of the front cylinder 10 in such a manner that the claws 33 provided at an outer circumference of the cosmetic material retaining section 31 are engaged with the engagement grooves 16, and the cylindrical body 30 is pushed in until the engagement convex section 21 provided at an outer circumference of the cylindrical body 20 is fitted in the engagement concave section 15 provided at an inner circumference of the front cylinder 10. Thus, the cylindrical body 20 and the rod 30 are incorporated in the front cylinder 10, whereby the cartridge 1 is completed.

Further, when the cartridge 1 is installed at the container body 2, if the cartridge 1 is inserted in an upper opening of the container body 2 from the side of a lower part 13 of the front cylinder 10, the spline shaft 43 of the container body 2 will be fitted in the spline section 25 provided at a base end of the cylindrical body 20, and further the engagement convex 14 provided on an outer circumference surface of the front cylinder 10 will be fitted in the engagement concave section 41 provided on an inner circumferential surface of the container body 2. Thus, the front cylinder 10 will easily be installed in such a manner that the front cylinder 10 can rotate with respect to the container body 2 and the cylindrical body 20 cannot rotate with respect to the container body 2. And, if the front cylinder 10 is rotated with respect to the container body 2, the front cylinder 10 and the cylindrical body 20 will be rotated.

Incidentally, since the stick type cosmetic material 4 is supported by the claws 33 and a side sliding surface is supported by the inner circumferential surface 17 of the cosmetic material housing hole 11A, the cartridge according to this embodiment is suitable for the stick type cosmetic material 4 which has a relatively large diameter and is relatively soft.

The operation will subsequently be described.

When the stick type cosmetic material 4 is fed from the cartridge 1, the front cylinder 10 of the cartridge 1 is rotated in a predetermined direction with respect to the container body 2. Then, the rod 30 which is engaged with the front cylinder 10 via the sliding mechanism (the claws 32 and the engagement grooves 16) is rotated synchronously with the front cylinder 10. On the other hand, the cylindrical body 20 connected by spline with the container body 2 does not rotate and therefore the cylindrical body 20 and the rod 30 are rotated relatively to each other.

Thus, the plurality of engagement projections 35 of the rod 30 are spirally engaged with the spiral groove 23 of the spiral cylinder section 22 one after another, and the rod 30 is fed from a front end side of the cylindrical body 20. In this case, since the rod 30 is engaged with the front cylinder 10 via the sliding mechanism as described above, the rod 30 does not rotate with respect to the front cylinder 10, but makes a stroke in an axial direction. Therefore, the stick type cosmetic material 4 retained by the cosmetic material retaining section 31 which is provided at a front end of the rod 30 is fed from the opening 12, which is provided at a front end of the front cylinder 10, without rotating with respect to the front cylinder 10.

On the other hand, in order to retract the stick type cosmetic material 4 in the cartridge 1, if the front cylinder 10 is rotated in a direction opposite to the prescribed direction described above with respect to the container body 2, the rod 30 will make a stroke in a direction opposite to the cylindrical body 20 and the stick type cosmetic material 4 will be retracted in the front cylinder 10.

Further, an upper stroke limit and a lower stroke limit of such a stick type cosmetic material 4 are defined to be a stroke position where the stopper member 34 comes into contact with the downward step section 22A which is a lower end of the spiral cylinder section 22 and a stroke position where a lower end of the cosmetic material retaining section 31 comes into contact with the upper end 20A of the cylindrical body 20. Therefore, the stroke of the stick type cosmetic material 4 is stabilized.

As described above, according to the present invention, the plurality of engagement projections 35 are installed at the rod 30 covering at least range of the movement from the upper stroke limit to the lower stroke limit, namely, a sphere which can cover an effective stroke length. According to the stroke position, these engagement projections 35 are engaged with the spiral groove 23 of the spiral cylinder section 22 one after another. Thus, even though the length of the spiral groove 23 of the spiral cylinder section 22 is dramatically shorten, an effective stroke of the stick type cosmetic material can be secured.

Therefore, when the spiral cylinder section 22 is manufactured by die forming, drawing from a core pin which is a die member can easily be performed and a special mechanism for rotating the core pin or the like is not required, whereby the spiral cylinder section 22 can easily be manufactured at a small cost.

Further, feeding operation of the cartridge 1 can be performed if at least one engagement projection 35 is spirally engaged with the spiral cylinder section 22. Thus, the length of the spiral cylinder section 22 of the cylindrical body 20 can optionally be set according to the pitch of the engagement projections 35, thereby enhancing flexibility in design of the cartridge 1.

Further, since the container body 2 is composed of only a cylinder having the bottom section 42, the engagement concave section 41, and the spline shaft 43, it can easily be manufactured as a single member by die forming.

Further, the cylindrical body 20 and the container body 2 are connected by the spline section 25 and the spline shaft 43 which are formed at an inner circumference of a base end of the cylindrical body 20. Thus, when the cartridge 1 is installed at the container body 2, the cylindrical body 20 and the container body 2 can easily and securely connected in such a manner that they cannot rotate relatively to each other.

Incidentally, in this embodiment, the claws 33 are provided as an engagement section of the sliding mechanism and the engagement grooves 16 are provided as a sliding section. However, the present invention is not restricted to such an embodiment. As long as the engagement section is guided along the sliding section, any type of embodiment is applicable. Further, as long as the sliding mechanism guides the rod 30 in such a manner that the rod 30 can slide in an axial direction and cannot rotate in a rotary direction with respect to the front cylinder 10, the sliding mechanism does not have to be composed of the engagement section and the sliding section. For example, it may be constituted such that the cosmetic material retaining section 31 and the cosmetic material housing hole 11A which are ellipses or polygons having different diameters, respectively, are engaged.

Figure 4:
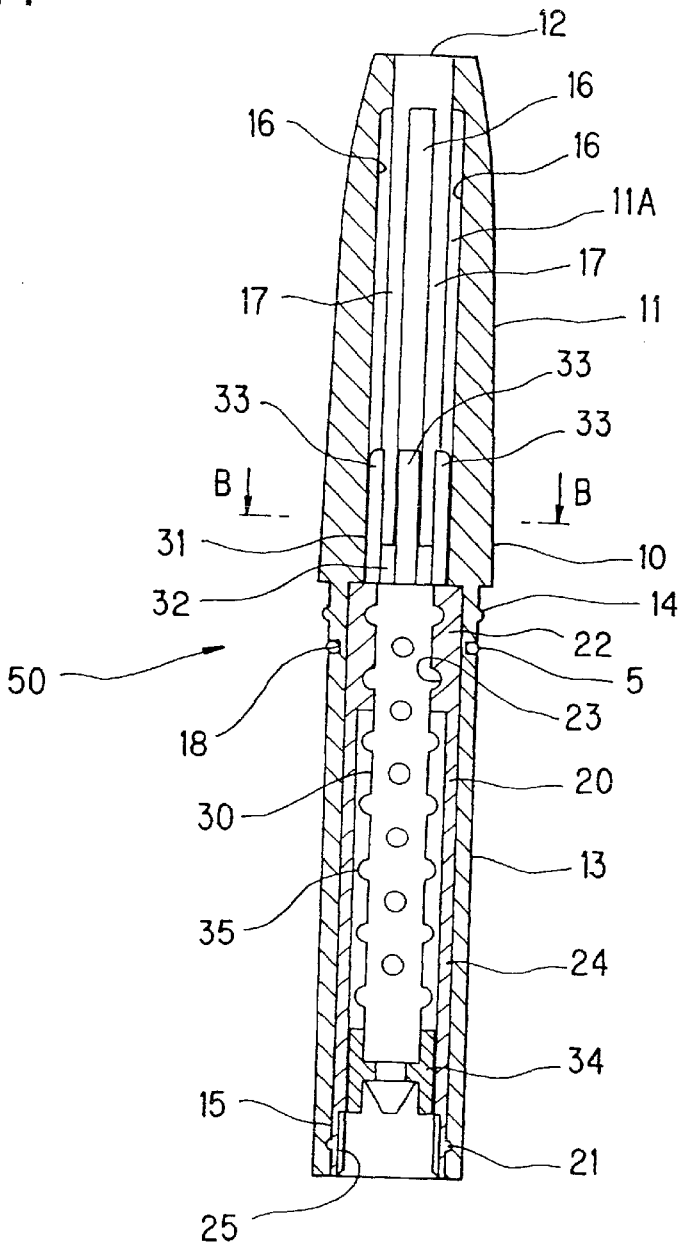
FIG. 4 is a sectional view showing a cartridge according to a second embodiment of the present invention.
Figure 5:
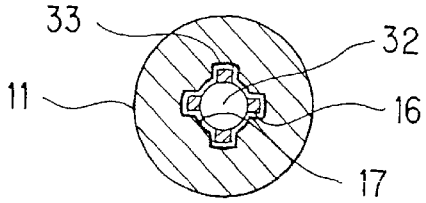
FIG. 5 is a sectional view taken along line B—B of FIG. 4.
Figure 6:
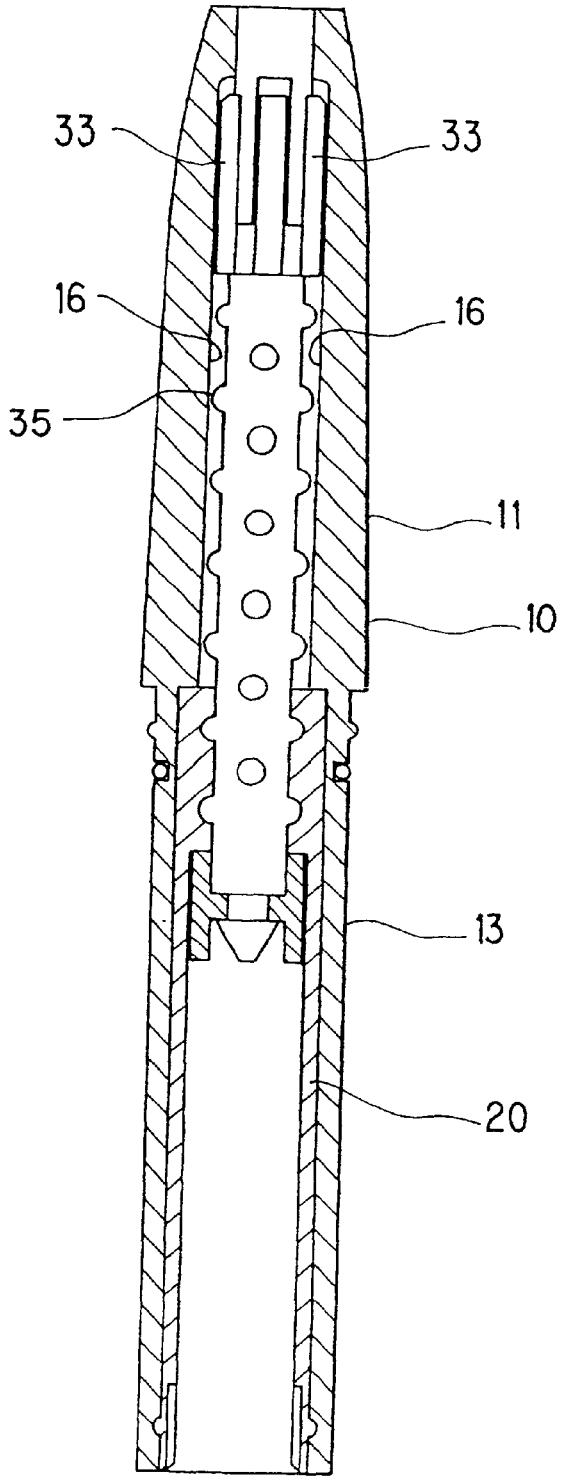
FIG. 6 is a sectional view showing a state that a rod is fed out.

In FIGS. 4 to 6, a cartridge 50 for a cosmetic container according to a second embodiment of the present invention is shown. As shown in the drawings, the cartridge 50 is almost in common with the cartridge 1 (refer to FIGS. 1 and 2) according to the first embodiment described above in their fundamental constitution (therefore, the same numerals are attached to the corresponding components). However, they differ in that an outside diameter of the rod 30 is almost as large as an inside diameter of the cosmetic material housing hole 11A. In the cartridge 50, as shown in FIG. 6, when the rod 30 is fed from the cylindrical body 20, the engagement projections 35 are engaged with the engagement grooves 16 one after another.

More specifically, by the spiral engagement with the spiral groove 23, the engagement projections 35 operate as a component section of the feeding mechanism, and the engagement projections 35 fed on the side of the cosmetic material housing hole 11A operate also as an engagement section of the sliding mechanism by the engagement with the engagement grooves 16.

Thus, in the cartridge 50 according to this embodiment, the stroke of the rod 30 can be more stabilized, and when a load in a torsional direction is applied to the cartridge 50, the cartridge 50 is supported by the engagement projections 35, whereby the cartridge 50 can stand a load in a torsional direction.

Therefore, the cartridge 50 according to this embodiment is more suitable for the stick type cosmetic material 4 which is soft and has a small diameter as compared with the cartridge 1 according to the first embodiment.

Incidentally, FIGS. 4 to 6 show a state that the stick type cosmetic material 4 is not retained at the cosmetic material retaining section 31. Further, it is arranged such that the O-ring 5 is installed at a ring groove 18 formed at an outer circumference of the lower part 13 of the front cylinder 10.

Figure 7:
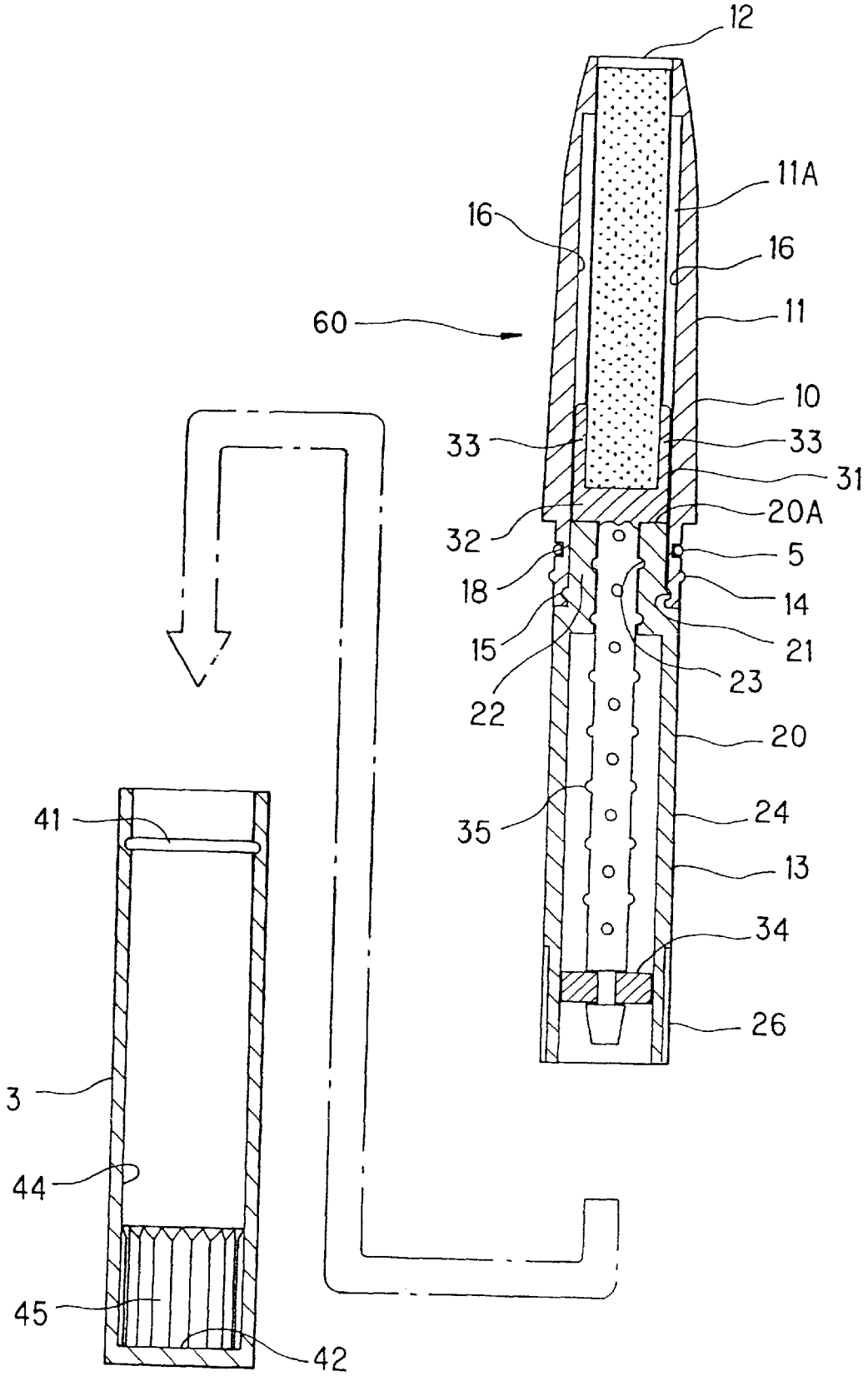
FIG. 7 is a sectional view showing a cartridge and a container body according to a third embodiment of the present invention.

FIG. 7 shows a cartridge 60 according to a third embodiment of the present invention and the container body 3 in which the cartridge 60 is contained.

As shown in the drawing, the cartridge 60 differs from the cartridge 1 (refer to FIGS. 1 and 2) according to the first embodiment described above in that the cylindrical body 20 is not entirely housed in the front cylinder 10 and the skirt section 24 provided at the base end is exposed outside the front cylinder 10, and the spline section 26 (female spline) is formed not at an inner circumference on the base end side of the cylindrical body 20 (skirt section 24), but at an outer circumference of the cylindrical body 20. Other fundamental constitution is common to these cartridges (thus, the same numerals are attached to the corresponding components). However, the O-ring 5 is installed at the ring groove 18 formed at an outer circumference of the lower part 13 of the front cylinder 10 similarly to the second embodiment described above.

Further, a spline section 45 (male spline) is formed on an area of an inner circumferential surface 44 of the container body 3 which is situated near the bottom surface 42.

Due to such constitution, when the cartridge 60 according to this embodiment is housed in the container body 3, the spline section 26 provided at an outer circumference of the cylindrical body 20 is connected by spline with the spline section 45 provided at an inner circumference of the container body 3, and the cylindrical body 20 and the container body 3 are unrotatably connected.

Figure 8:
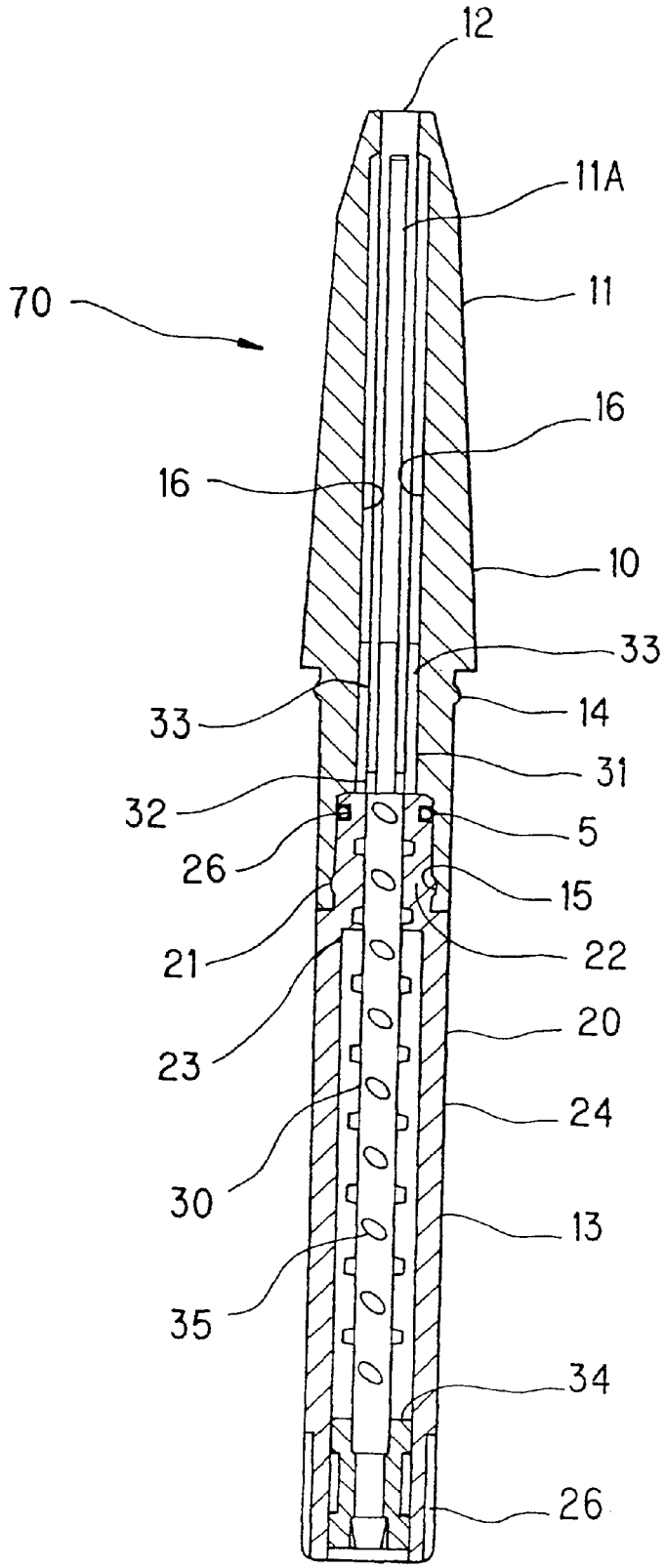
FIG. 8 is a sectional view showing a cartridge according to a fourth embodiment of the present invention.
Figure 9:
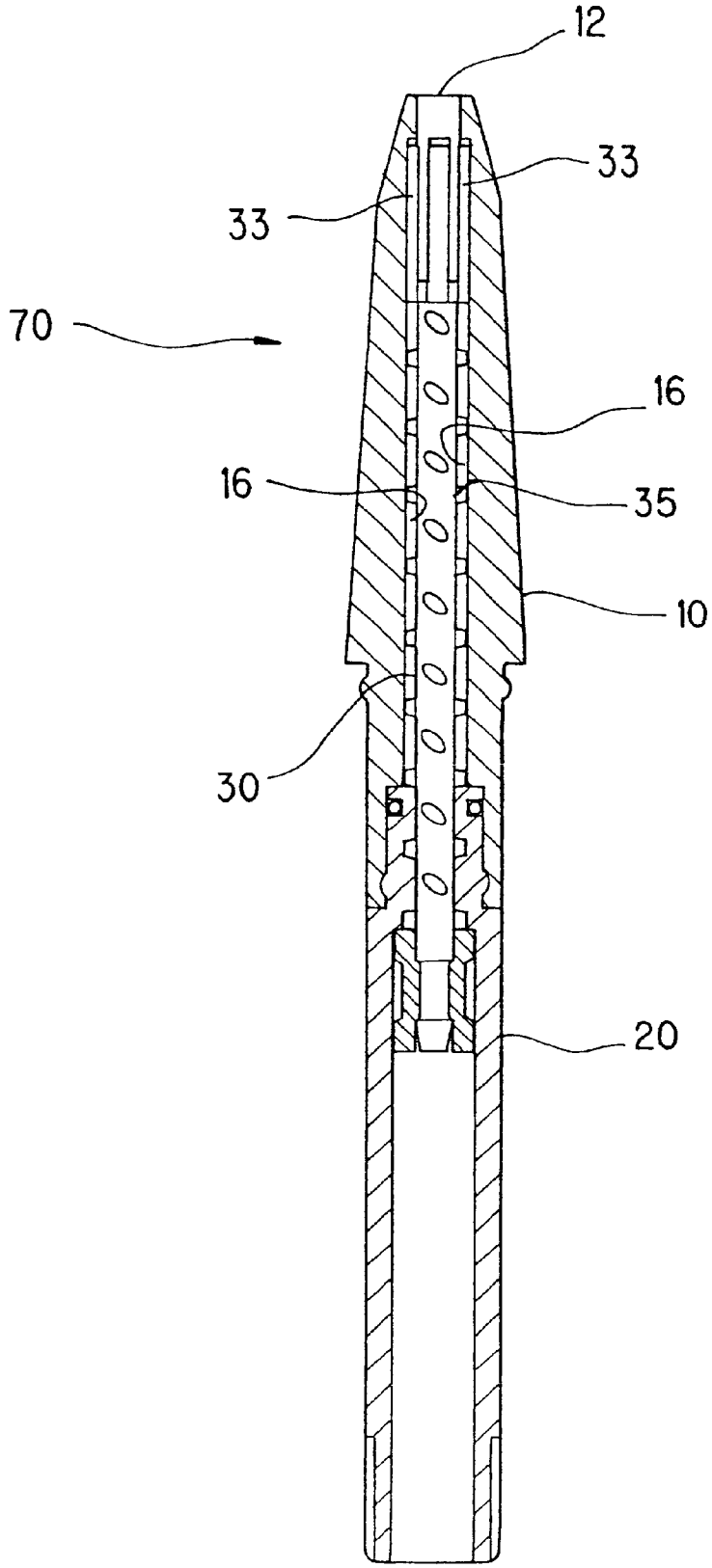
FIG. 9 is a sectional view showing a state that a rod is fed out.

In FIGS. 8 and 9, a cartridge 70 according to a fourth embodiment of the present invention is shown.

As shown in the drawing, the cartridge 70 differs from the cartridge 1 (refer to FIGS. 1 and 2) according to the first embodiment described above in that when the rod 30 is fed on the side of the cosmetic material housing hole 11A, the engagement projections 35 are engaged with the engagement grooves 16 one after another like the second embodiment (refer to FIG. 9), and the spline section 26 is formed at an outer circumference of the base end of the cylindrical body 20 like the third embodiment. However, other fundamental constitution is common to these cartridges (thus, the identical numerals are attached to the corresponding components).

Incidentally, a container body in which the cartridge 70 is housed is a type similar to that of the container body 3 shown in FIG. 7 (a type which the spline section 45 is formed on the side of the bottom surface 42 of the inner circumferential surface 44).

A shape of the engagement projections 35 is an inclined ellipse so as to match an inclination of the spiral groove 23.

In this embodiment, due to such constitution, an outside diameter of the cartridge 70 (cartridge body) can be specially narrow. In other words, an inside diameter of the cosmetic material housing section 11A of the front cylinder 10 can be as small as an outside diameter of the rod 30. Further, the cylindrical body 20 does not have to be constituted such that a spline shaft connects with an inner circumference of the base end of the cylindrical body 20, whereby a diameter of the cylindrical body 20 can be small. Thus, both of the front cylinder 10 and the cylindrical body 20 can be of small diameter and the cartridge body can be thin. Consequently, the cartridge 70 according to this embodiment is especially suitable for the stick type cosmetic material 4 of small diameter.

In each of the embodiments described above, supposing that, for example, the container body 3 is resinous (spline processing can easily be performed), it is arranged such that the container body 3 is connected with the cartridge 60 or 70 by spline. However, the present invention is not restricted to such embodiments.

Figure 10:
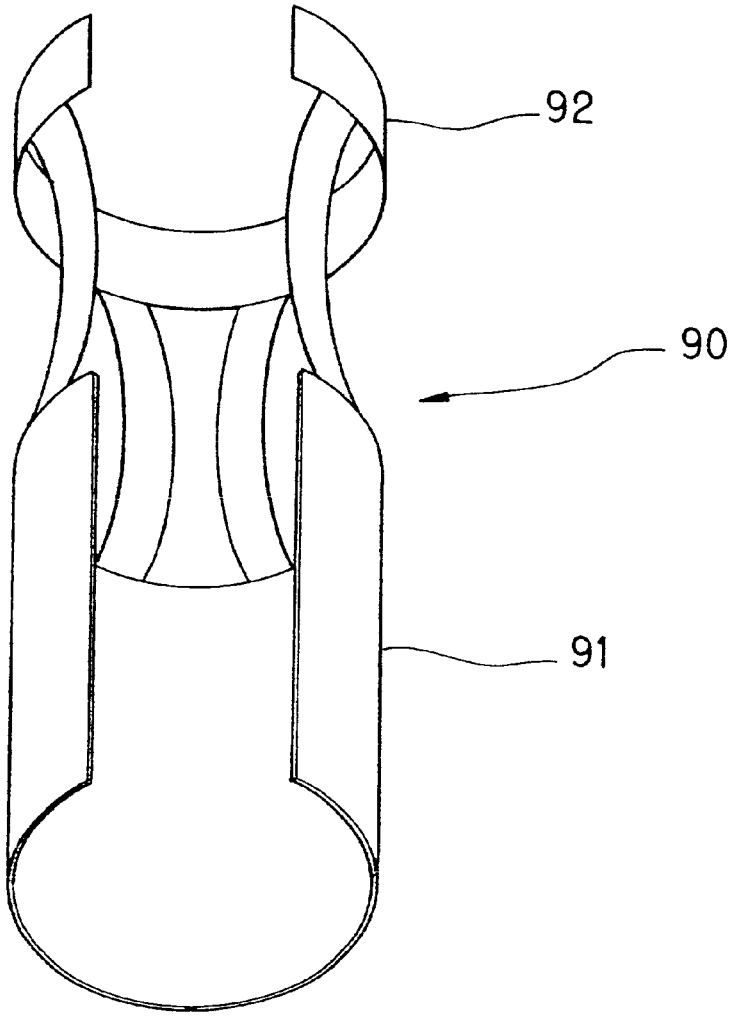
FIG. 10 is a perspective view showing a spring member for fixing a container body and a cartridge.
Figure 11:
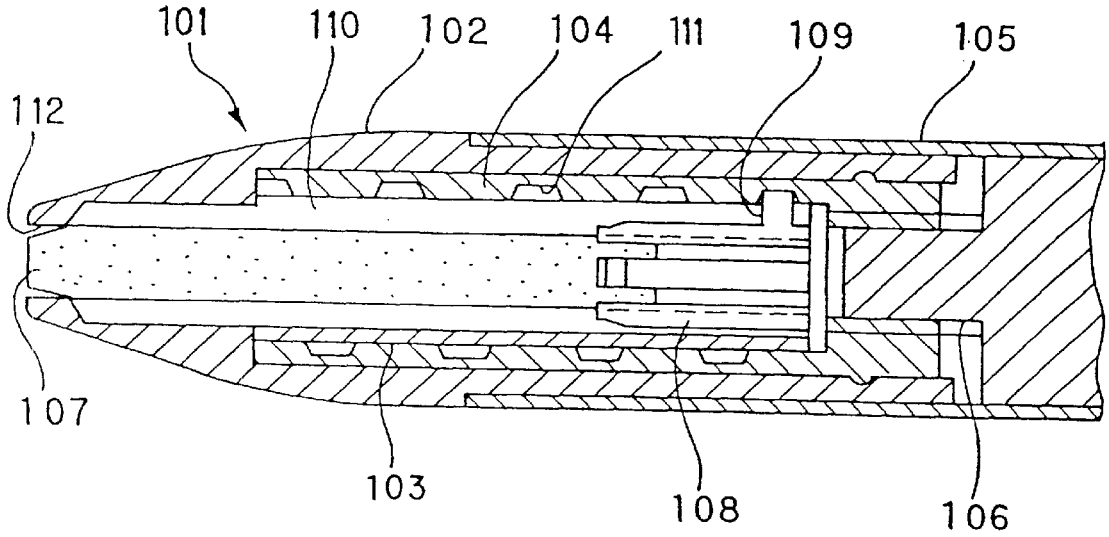
FIG. 11 is a sectional view showing a conventional cosmetic container.
Figure 12:
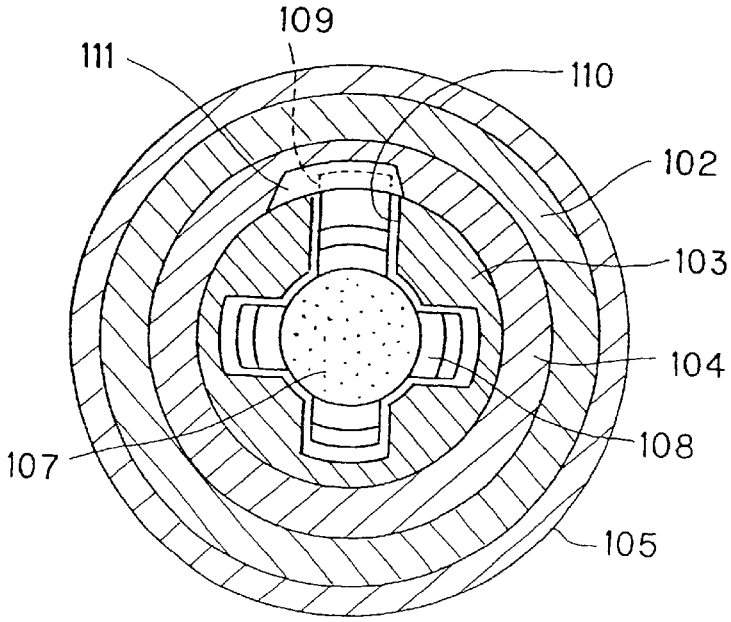
FIG. 12 is a sectional view showing the conventional cosmetic container of FIG. 11.
Figure 13:
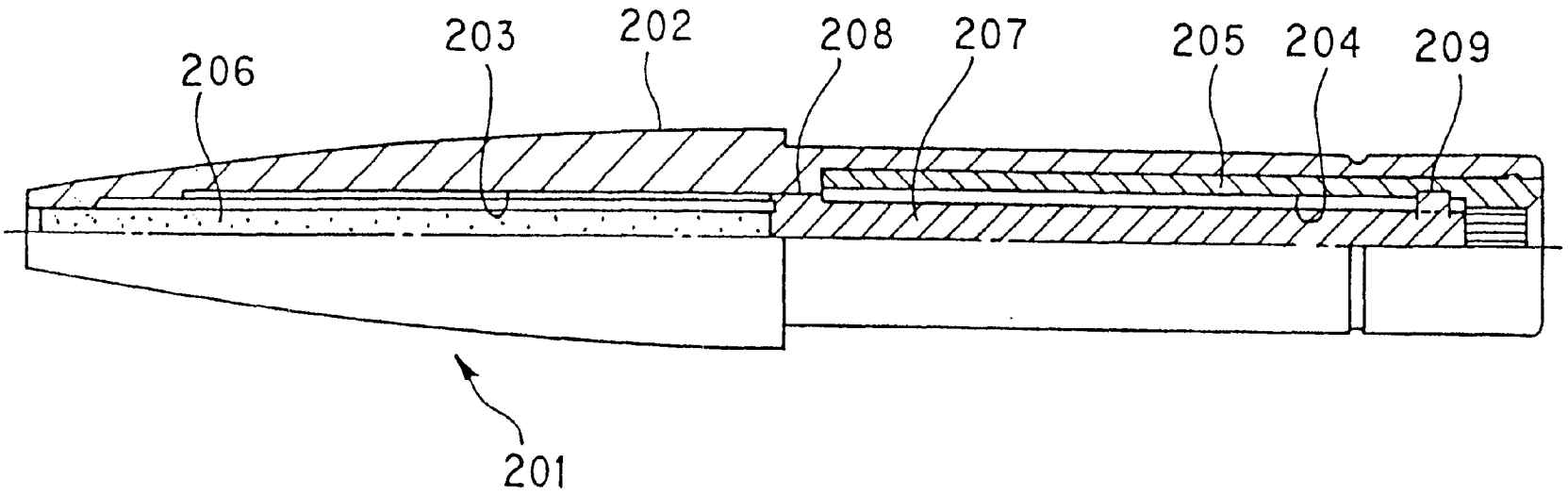
FIG. 13 is a sectional view showing another conventional cosmetic container.

For example, if the container body 3 is made of metal, it will be possible that a spring member 90 as shown in FIG. 10 is installed at a bottom section which is provided at an inner circumference of the container body 3 and the container body 3 is connected with the cartridge 60 or 70.

The spring member 90 is composed of a leaf spring, and it is provided with a cylindrical container body fixing section 91 and a cartridge retaining section 92 which are vertically connected. The spring member 90 is fixed to an inside of the container body 3 through the container body fixing section 91 which applies spring force in a direction of the outside diameter, and also when the cartridge 60 or 70 is inserted, an outer circumference of the cartridge 60 or 70 is retained by the cartridge retaining section 92 which applies spring force in a direction of the inside diameter.

By using such a spring member 90, it is not necessary to carry out spline processing which will be difficult if the container body 3 is made of metal. Thus, by manufacturing a metal container body 3, it is possible to provide high quality to a cosmetic container.

What is claimed is:

1. A cosmetic container comprising:

a cartridge including a front cylinder for feeding a stick type cosmetic material through a front end opening, a cylindrical body to be connected with the front cylinder coaxially and rotatably and having a spiral groove, a rod inserted in the cylindrical body, a feeding mechanism for feeding out the rod while the rod is spirally engaging the spiral groove, by relative rotations of the front cylinder and the cylindrical body, a cosmetic material retaining section formed on a front end side of the rod within the front cylinder, and a sliding mechanism by which the cosmetic material retaining section is slidable in an axial direction of the front cylinder, the sliding mechanism restraining rotation of the cosmetic material retaining section around an axis of the front cylinder;

a container body housing the cartridge in such a manner that the cartridge is freely attachable to and detachable from the container body; and connecting means for fastening the front cylinder in an axial direction of the container body such that the front cylinder is rotatable and for connecting the cylindrical body to the container body such that the cylindrical body is nonrotatable with the container body when the cartridge is housed in the container body.

2. A cosmetic container according to claim 1, further comprising a stopper member on a base end side of the rod, the cylindrical body having a downward step section, wherein during a stroke of the rod the stopper member and the downward step section come into contact with each other at a location defining a stroke uppermost limit of the rod.

3. A cosmetic container according to claim 1, wherein the feeding mechanism includes a plurality of engagement projections spirally engaged with the spiral groove and formed at an outer circumference of the rod, the plurality of engagement projections being formed in an axial direction of the rod extending over a projections range greater than the length of a stroke of the rod, the spiral groove engaging the engagement projections over an engagement range of engagement measured in a direction of the stroke of the rod, the engagement range consisting of a part less than all of the projections range.

4. A cosmetic container according to claim 1, wherein the sliding mechanism comprise:

a plurality of claws that constitute the cosmetic material retaining section; and a plurality of engagement grooves at an inner circumference of the front cylinder, which slidably engage the claws in such a manner that the claws are nonrotatable, and are slidable in the axial direction of the front cylinder.

5. A cosmetic container according to claim 4, wherein the plurality of engagement projections are arranged coaxially with the claws and engage the engagement grooves when fed out from a front end side of the cylindrical body.

6. A cosmetic container according to claim 1, the cosmetic container further comprising an O-ring between on a front end side of the cylindrical body and an inner circumference of the front cylinder, the O-ring providing frictional resistance to relative rotations of the cylindrical body and the front cylinder.

* * * * *